US005848748A

United States Patent [19]

Bouraoui et al.

[11] Patent Number: 5,848,748

[45] Date of Patent: Dec. 15, 1998

[54] CORRUGATED GABLETOP CARTON

[75] Inventors: Hichem T. Bouraoui, Palatine, Ill.; Patrick Duvander, Lund, Sweden

[73] Assignee: Tetra Laval Holdings & Finance, S.A., Pully, Switzerland

[21] Appl. No.: 879,096

[22] Filed: Jun. 19, 1997

[51] Int. Cl.[6] ..... B65D 5/74

[52] U.S. Cl. ..... 229/125.42; 229/939; 229/5.82; 229/5.84

[58] Field of Search ..... 229/137, 125.15, 229/3.5 R, 3.5 MF, 3.1; 220/441, 443; 428/163, 167, 246, 34.1

[56] References Cited

U.S. PATENT DOCUMENTS

| | | |
|---|---|---|
| 1,009,993 | 11/1911 | Parrish . |
| 2,300,433 | 11/1942 | Palmer . |
| 3,244,353 | 4/1966 | Miessler . |
| 3,659,772 | 5/1972 | Dorsey et al. . |
| 4,088,261 | 5/1978 | Osborne . |
| 4,238,069 | 12/1980 | Morris, Jr. . |
| 4,530,460 | 7/1985 | Hinton . |
| 4,687,130 | 8/1987 | Beeler . |
| 4,746,061 | 5/1988 | Arvanigian . |
| 4,792,048 | 12/1988 | Wyberg . |
| 4,913,292 | 4/1990 | Field . |
| 4,989,736 | 2/1991 | Andersson . |
| 5,205,473 | 4/1993 | Coffin, Sr. . |
| 5,307,982 | 5/1994 | Swindell . |
| 5,501,394 | 3/1996 | Eno . |

*Primary Examiner*—Gary E. Elkins
*Assistant Examiner*—Tri M. Mai
*Attorney, Agent, or Firm*—Michael A. Catania

[57] ABSTRACT

A gabletop carton for storing liquid, viscous and solid material includes a carton material stock formed of paperboard having at least an inner facing sheet, an outer facing sheet and a fluted medium fixedly positioned between the inner and outer facing sheets. The fluted medium is positioned between the inner and outer facing sheets so as to define substantially flat, inner and outer facing sheet surfaces. The carton material stock is formed to define a bottom wall, a plurality of upstanding side walls and a top portion having a gable configuration. The bottom wall is contiguous with the upstanding side walls which are defined by a plurality of side wall creases in the material stock. The bottom wall is defined by a plurality of bottom wall creases in the material stock that are generally transverse to the side wall creases. The top portion is formed by a plurality of top wall creases generally parallel to the bottom wall creases, and a plurality of angled gable creases formed in at least some of the side walls so as to form inner and outer gable walls. The fluted medium has a flute density of about 250 flutes per linear foot and is formed to define a plurality of columns that are oriented generally transverse to the side wall creases. The inner and outer facing sheets can include a polymeric material applied thereto.

2 Claims, 2 Drawing Sheets

CORRUGATED GABLETOP CARTON

FIELD OF THE INVENTION

This invention relates to a gabletop carton. More particularly, the invention relates to a gabletop carton formed of corrugated board for liquid, viscous and particulate goods packaging and storage.

BACKGROUND OF THE INVENTION

Cartons are in widespread and versatile use for the storage of liquid and viscous materials, and dry goods including food items. One type of carton or container is the commonly recognizable gabletop carton. The gabletop carton includes four side panels which are finished, at the top, with a peaked, gable-like configuration. Such cartons are used for packaging and storing liquid foods such as milk, juice and the like, as well as other, consumer liquid products such as laundry detergent. Gabletop cartons are also used for storing dried, powdered and granulated goods, such as dried soups. Such cartons are also known for use in storing medicinal goods such as powdered or granulated Epsom salts.

Traditionally, such cartons are formed from "blanks" which are formed or erected and transported into a filling apparatus in which the carton is filled and the top or gable portion folded and sealed. The blanks are shipped and stored unformed or flat. The cartons are generally erected within the filling machine.

In the development of gabletop cartons, many improvements have been made in the design and manufacture of the spout portion, which is that portion of the container from which the contents of the container are dispensed. In one common configuration, the spout is formed from triangular panels that open outwardly to form a V-shaped dispensing opening. The panels fold back, inwardly, to form a reclosure of the dispensing opening after use.

Recently, one improvement that has been incorporated into many gabletop cartons is a plastic or like, polymeric spout that is mounted to the container at the gable. Such spouts may include threaded closure caps or hinged-type closure caps to close the spout and provide a seal for the carton.

Other improvements that have been made in the design and construction of such cartons have been in the materials of construction. In their current form, gabletop cartons are formed of a laminate of, primarily, solid wall paperboard. The solid wall paperboard can be a single layered or a multi-layered configuration having a substantially void-less construction. The laminated structures may include inner and outer layers of polymeric material, such as low density polyethylene. Still other cartons include a barrier layer, such as a metal foil, to reduce the gas permeability of the carton.

Those skilled in the art will recognize that the principal cost in the manufacture of gabletop cartons is associated with the materials. That is, the laminated or otherwise prepared paperboard is typically the highest cost component in the manufacture of cartons. Paper products are often measured in "grammage", which is the weight of the board in grams per square meter (gms/m$^2$). As such, increased "grammage" of materials generally correlates to increased cost.

Accordingly, there continues to be a need for a lighter weight material for the manufacture of paperboard and paperboard-like gabletop cartons. Such a material and carton configuration provides strength and durability in a reduced cost package for packaging and storing solid, viscous and liquid goods.

SUMMARY OF THE INVENTION

A gabletop carton for storing liquid, viscous and solid materials comprises a carton material stock formed of paperboard and having at least an inner facing sheet, an outer facing sheet and a fluted medium positioned and affixed between the inner and outer facing sheets so as to define substantially flat, inner and outer facing sheet surfaces.

The carton material stock is formed to define a bottom wall, a plurality of upstanding side walls and a top portion having a gable configuration. The bottom wall is contiguous with the upstanding side walls. The side walls are defined by a plurality of side wall creases in the material stock. Likewise, the bottom wall is defined by a plurality of bottom wall creases in the material stock that are extensions of and generally transverse to the side wall creases. The top portion is formed by a plurality of top wall creases that are generally parallel to the bottom wall creases. A plurality of angled gable creases formed in at least some of the side walls form inner and outer gable walls.

The fluted medium defines a plurality of columns. In a preferred construction, the side wall creases are generally transverse to the columns. That is, the columns traverse across the side walls of the carton.

Preferably, at least one of the inner and outer facing sheets has a polymeric material, such as low density polyethylene applied thereto. Both the inner and outer surfaces of the material, and of each facing sheet can include such a polymeric material application. Optionally, the material stock can include a barrier material, such as a metal foil, disposed on the inner facing sheet to enhance the gas impermeability characteristics of the carton.

Various sizes of corrugated material can be used. The material construction can vary depending upon the volume and strength requirements of the carton, and the intended end use of the carton. Preferably, the corrugated material has a flute density of about 100 to about 400 flutes per linear foot, and a flute height profile of about 8 mils to about 50 mil. Most preferably, the material has a density of about 250 flutes per linear foot and a height profile of about 8 mils to about 40 mils.

Other features and advantages of the present invention will be apparent from the following detailed description, the accompanying drawings, and the appended claims.

DETAILED DESCRIPTION OF THE PREFERRED EMBODIMENTS

Figure 1:
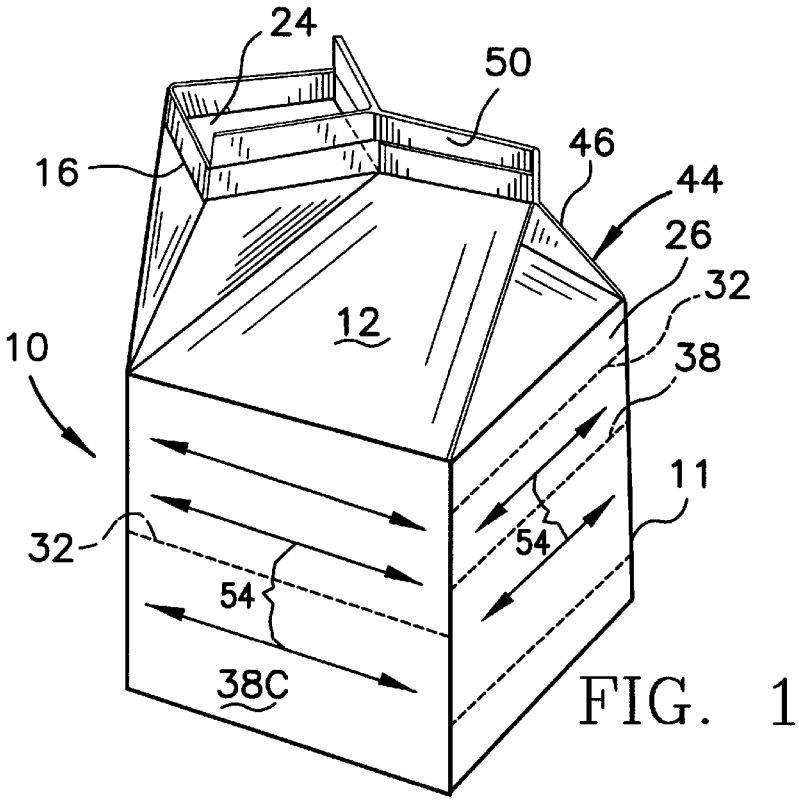
FIG. 1 is a perspective view of a corrugated gabletop carton embodying the principles of the present invention, the carton being shown with an integral flap-type pour spout, and being shown, for illustrative purposes, with flute column lines thereon.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Referring now to the figures and in particular to FIG. 1, there is shown a gabletop carton 10 formed of a corrugated material 12, 12'. The carton 10 defines a product storage region 11 and is adapted to directly store liquid products, such as milk and juice, viscous products, such as mayonnaise, and solid, e.g., granulated or powdered products. The carton 10 is configured to store these products without an intervening liner, such as a flexible polymeric bag disposed between the product and the carton. The carton 10 is formed from a material 12, 12' that is first prepared into a form commonly referred to as a carton "blank," illustrated at 14 in FIG. 3, to facilitate erecting the carton 10. The carton 10 shown in FIG. 1 includes a pour spout 16 formed from a portion of the carton material 12, 12'. The pour spout 16 folds back, inward of the carton 10 to form a reclosure for the carton 10.

The carton blank 14 is formed from a paperboard material 12, 12'. In known cartons formed of a typical solid wall construction, the material weight or grammage will vary depending upon the size and strength requirements of the carton, the weight and state (e.g., liquid or solid) of the contained product and the intended end use of the carton. In a known one-liter carton, the paperboard grammage is about 280 to about 300 gms/$m^2$.

In a common arrangement for liquid packaging and storage, the carton material 12, 12' is formed from a laminated structure. One known laminate includes a paperboard substrate having a layer or a coating of a polymeric material, such as low density polyethylene (LDPE) on both sides of the substrate. The "sides" of the substrate are the inside and outside surfaces of the carton when the carton is erected.

The polymeric layers provide a measure of liquid impermeability to the material, thus providing a substantially "leak-resistant" carton, with the inner polymeric layer preventing leakage from the carton outward, and the outer polymeric layer retarding moisture or humidity transfer from the environs inward. The laminated structure also reduces wicking of the material, which is absorption of liquid by the carton material, and subsequent mass transfer of the liquid from the site of absorption.

The laminate may also include a barrier layer adjacent to the substrate, between the substrate and the inner polymeric layer. The barrier layer enhances gas impermeability of the carton which facilitates retaining the container contents fresh. The barrier layer can be positioned directly on the substrate. Alternately, and preferably, the laminate can include a polymeric layer between the barrier layer and the substrate as well as a polymeric layer over the barrier. In this configuration, the polymeric layer that is disposed between the barrier and the substrate can serve to adhere the barrier and substrate to one another. Such barrier layers are used, typically, in cartons for storing fruit juice and the like.

A major cost in the manufacture of such cartons is the cost of the paper materials, which correlates to paper grammage for each carton. As such, any reduction in carton grammage generally brings about a savings in the cost of the carton. However, relatively lighter weight materials, i.e., lower grammage materials, generally have less strength than materials having a higher grammage. As such, a balance must be made between cost reduction and strength.

Figure 2A:
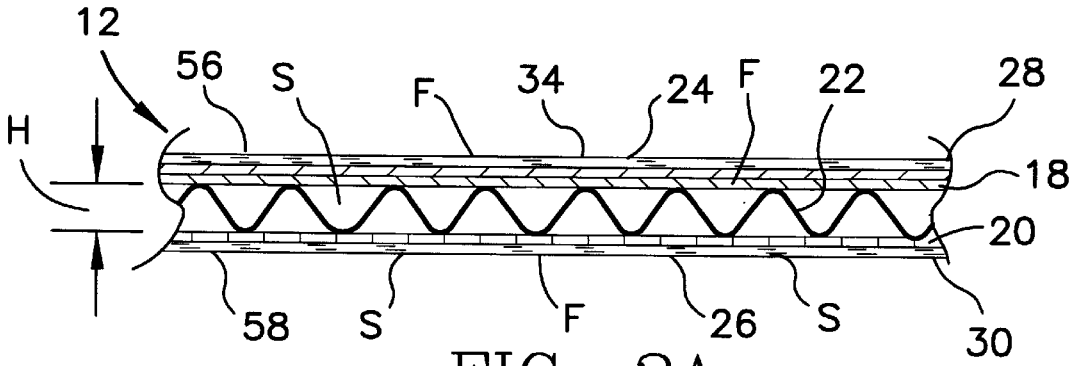
FIG. 2A is a cross-sectional view of the carton body showing an exemplary material combination, e.g., a laminate, from which the carton can be formed.
Figure 2B:
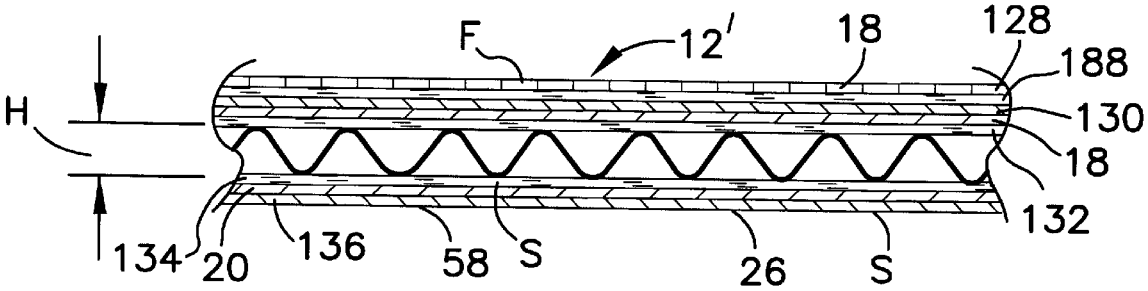
FIG. 2B is a cross-sectional view similar to FIG. 2A, illustrating another exemplary laminate from which the carton can be formed.

The carton 10 illustrated in FIG. 1 is manufactured from a corrugated paperboard material 12, 12'; cross-sections of exemplary materials 12, 12' are shown in FIGS. 2A and 2B. Referring to FIG. 2A, the material 12 includes an inner facing sheet 18, an outer facing sheet 20 and a fluted medium 22 positioned between the inner and outer facing sheets 18, 20. The fluted medium 22 contacts and is fixed between the inner and outer facing sheets 18, 20. For purposes of the present discussion, the inner facing sheet 18 is the portion of the material 12, 12' that is inward of the carton 10, e.g., the inner surface 24 of the carton 10 that is in contact with the contained material, and the outer facing sheet 20 is that portion of the material 12, 12' that is outward of the carton 10, e.g., the outer surface 26 of the carton 10, that is handled by a user.

The inner and outer facing sheets 18, 20 can be formed from common paperboard material that have applied thereto a liquid resistant material such as the polymeric LDPE layers 28, 30 shown in FIG. 2A. The fluted medium 22 is typically formed from paperboard material that may have a liquid resistant material applied to one or both sides thereof, or may be used untreated.

Alternately, as shown in FIG. 2B, the inner and outer facing sheets 18, 20 can have polymeric layers 130, 132 and 134, 136 disposed on each side of each facing sheet 18, 20 to serve as an adhesive to adhere the materials to one another. The polymeric layers 130, 132 and 134, 136 further reduce moisture transfer. As previously discussed, in a construction that includes a gas impermeable barrier 138 such as foil, the foil 138 can be positioned on the polymeric layer 130, and an additional polymeric layer 128 can be provided over the foil 138.

When observed vertically, the flutes *f* define columns 32 that traverse the material 12, 12' in a direction perpendicular to the wave-like form shown in FIG. 2. That is, the columns 32 are oriented into and out of the figure sheet of FIG. 2. Preferably, the columns 32 are oriented to, in part, reduce possible bulging of the carton. This orientation also increases the grip stiffness of the carton. While the present discussion is directed to, and makes reference to the material 12 illustrated in FIG. 2A, it is to be understood that the present discussion applied equally well to the material 12' illustrated in FIG. 2B, as well as other corrugated material configurations.

When observed as a cross-section of the material traversing a plurality of columns 32, as seen in FIGS. 2A and 2B, the flutes *f* have an arch-like appearance. The arch is a basic structural shape that is capable of supporting substantial weight loads and is recognized as a structurally acceptable manner in which to span a given space. Those skilled in the art will also recognize that corrugated cartons can be formed having a plurality of walls, i.e., two or more corrugated media (not shown) having a facing sheet or liner board interposed between the corrugated media and facing sheets on the inner and outer surfaces thereof. It will be apparent from the drawings that the spaces s between the flutes *f* and between the flutes *f* and the facing sheets 18, 20 are open to the environs. It will also be recognized by those skilled in the art that the edges (from which the flutes *f* can be seen) can be sealed to seal the spaces s and prevent moisture ingress and wicking.

Referring to FIG. 2A, the material 12 can include one or more polymeric layers 28, 30, such as the aforementioned LDPE, to provide further liquid resistance, and a barrier layer 34 to provide gas impermeability. In a preferred arrangement, the barrier material 34 is a metal foil, such as aluminum foil. The barrier layer 34 reduces the passage of gas, such as oxygen, through the carton 10, and thus enhances the ability of the carton 10 to maintain the contents fresh. Typically, as provided previously, and as illustrated in FIG. 2B, the barrier layer 138 is disposed on the facing sheet 18 with a polymeric layer 130 between the facing sheet 18 and the barrier 138. An additional polymeric layer 128 is provided over the barrier 138 as an innermost laminate material.

Figure 3:
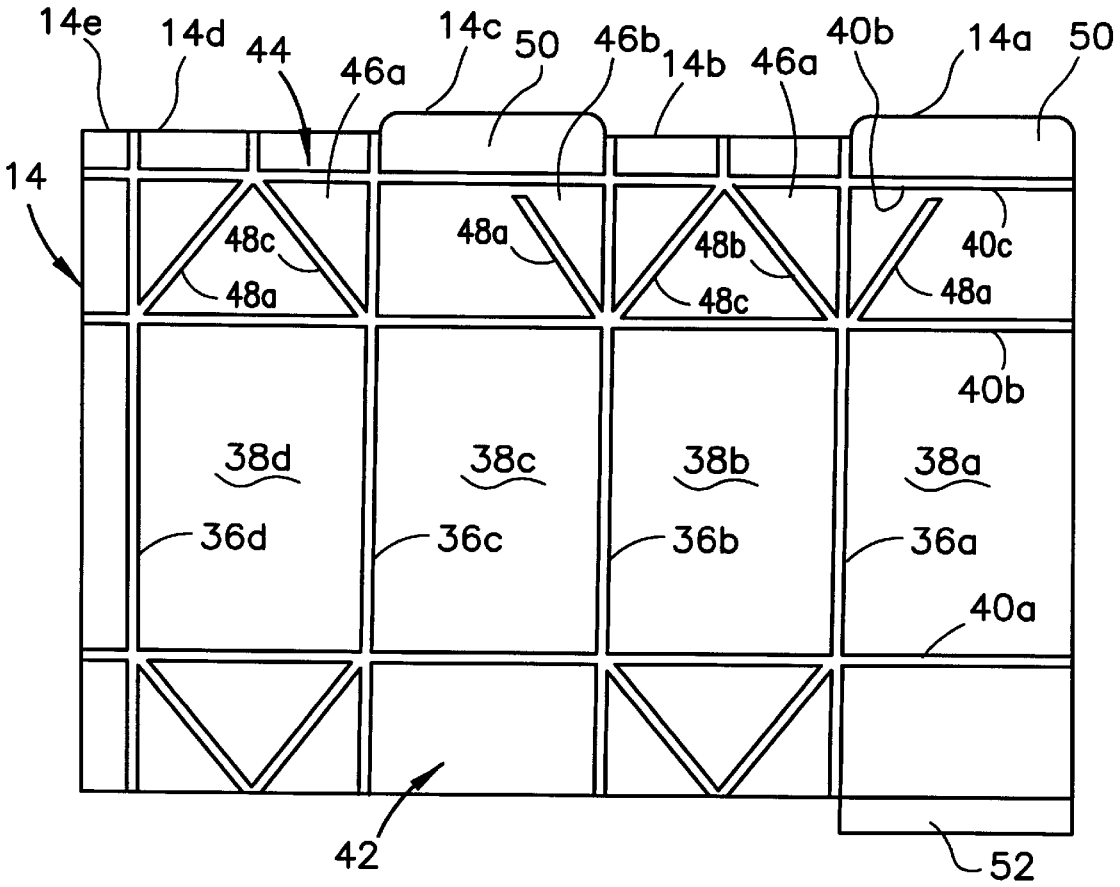
FIG. 3 is a view of an unassembled or unerected carton, commonly referred to as a carton blank.

Referring now to FIG. 3, there is shown a carton blank 14, in unerected form. The blank 14 includes five vertical panels 14*a–e* defined by four vertical score lines or creases 36*a–d*. Four of the vertical panels 14*a–d* define the side wallside walls 38*a–d* of the carton 10. The fifth vertical panel 14*e* provides a tab for sealing the carton blank walls 38*a* and 38*d* adjacent to one another when the carton 10 is erected or formed.

The blank 14 further includes three horizontal score lines or creases 40*a–c*. The lower horizontal line 40*a*, along with the portions of the vertical side wall creases 36*a–d* below the lower horizontal line 40*a*, define the bottom wall portion 42 of the carton 10. The two upper horizontal lines 40*b–c*, along with the portions of the vertical side wall creases 36*a–d* above the horizontal line 40*b*, define the top portion 44 of the carton 10 including the gable 46. The top portion 44 of the blank 14 also includes a plurality of angled gable creases or score lines 48*a–f* that define the gable 46 and pour spout 16. The gable includes inner and outer gable walls, 46*a* and 46*b*, respectively. Upper and lower fins 50, 52 facilitate sealing the carton blank walls 14*a–d* to one another when the carton 10 is erected.

A preferred embodiment of the carton 10 includes the carton material 12, 12' oriented such that the columns 32 traverse across the side walls 38*a–d*. That is, referring to FIG. 1, the columns 32 traverse in the direction shown by the lines indicated at 54. In this configuration, the columns 32 will intersect and will be redirected by the vertical side wall creases 36. As discussed previously, this orientation of the material 12, 12' reduces the opportunity for bulging of the carton walls 38*a–d*, and increases the carton's 10 grip stiffness.

Standards were, at one time, promulgated for fluted material in which material was identified by an alpha character followed by the word "flute". For example, "A-flute" represented a material having 33±3 flutes per linear foot and an approximate height of 3/16 inch exclusive of the facing thickness. "E-flute" represented a material having 90±4 flutes per linear foot and an approximate height of 3/64 inch exclusive of the facing thickness. Although various flute *f* sizes can be used for the present invention, it is contemplated that a preferred material 12, 12' has a density of about 100 to about 400 flutes *f* per linear foot and most preferably a flute density of about 250 flutes per linear foot. Preferably, the material 12, 12' has an approximate flute *f* height or profile h of about 8 mils to about 50 mils, and most preferably about 8 mils to about 40 mils, exclusive of the facing sheet 18, 20 thickness.

It will be understood that the flute *f* density and height profile can vary depending upon the pressure applied to the material 12, 12' during the converting process, as the material is introduced to pressure or nip rollers that facilitate application of the facing sheets to the fluted medium. The converting process and apparatus for carrying out the converting process are outside of the scope of the present application and will be readily understood by those skilled in the art.

Advantageously, the use of a material 12, 12' having a relatively high flute density, (i.e., closely or tightly positioned flutes) provides substantially flat inner and outer facing sheet outer surfaces 56, 58. That is, the outwardly facing surfaces 56, 58 of the inner and outer facing sheets 18, 20 define substantially flat planes that are readily printable with, for example, indicia such as graphics including logos and designs, information regarding the contents of the carton 10, and the manufacturer or packager. The tightly positioned flutes *f* also provide a carton 10 that has a smooth appearance rather than the ridged or rippled appearance generally associated with corrugated materials.

Figure 4:
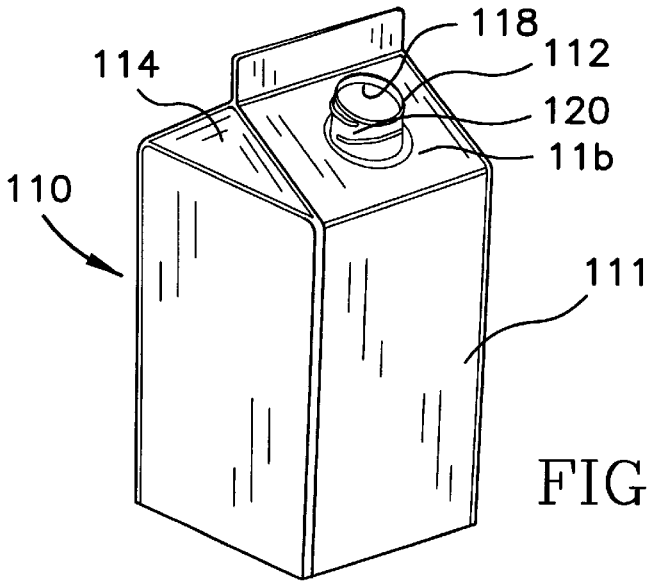
FIG. 4 is a perspective view similar to FIG. 1, illustrating a gabletop carton having a molded spout mounted thereto.

An alternate carton configuration 110 is illustrated in FIG. 4. The alternate embodiment 110 includes a molded spout 112 mounted to the corrugated material 111 carton 110 at the gable 114. The spout 112 is mounted to the carton 110 at a flange 116, and defines a dispensing opening 118 extending upwardly from the flange 116. The molded spout 112 is used in place of the flap-type pour spout 16 shown in the carton embodiment 10 illustrated in FIG. 1. The molded spout 112 can include a threaded body portion 120 that is adapted to receive a threaded closure cap (not shown). Other types of closures (not shown) are contemplated for use with the molded spout, including a hinged closure cap that is integral with the spout, such other closure types being within the scope of the present invention.

The novel use of a corrugated material 12, 12' for a packaging carton 10 for use, for example, for storing viscous materials and liquids such as juices, provides a number of advantages over the use of solid single or multi-layered paperboard materials. First, the weight of the carton 10 can be reduced by using a corrugated material 12, 12'. Commensurate with a reduction in weight, generally, is a reduction in cost. Moreover, there is no loss in structural strength or integrity of the carton 10 formed from corrugated material 12, 12'. Rather, it is contemplated that corrugated cartons 10 of the present invention can be configured to reduce weight over like solid wall cartons, while increasing the strength of the carton 10. Thus, when considering the carton 10 on the basis of strength per unit weight (e.g., strength per grammage), the present corrugated cartons 10 provide a significant advantage over the known solid single or multi-layered paperboard cartons.

The reduction in raw material requirements, e.g., material weight, associated with the manufacture of the carton 10 is commonly referred to as source reduction. Source reduction is the prevention of waste at its source by using the minimum quantity of materials necessary to achieve a given function. Use of corrugated materials in the manufacture of gabletop cartons, in accordance with the principles of the present invention furthers source reduction objectives. Thus, source reduction has environmental benefits as well as optimizing resources and minimizing costs.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A carton blank for a hermetically sealed gable top carton for use in packaging liquid food, the carton blank having a plurality of side panels, a plurality of top panels and a plurality of bottom panels, each of the panels defined by a plurality of vertical score lines and horizontal score lines, the carton blank comprising:

a corrugated layer composed of an inner facing sheet, an outer facing sheet and a plurality of flutes, each of the flutes fixedly positioned between the inner facing sheet and the outer facing sheet, the flutes having a density of between 200 to 400 flutes per linear foot and a height profile of 8 mils to 40 mils, the flutes defining a plurality of columns transverse to the plurality of vertical score lines;

a barrier layer adjacent the corrugated layer;

an exterior polyethylene coating layer; and an interior polyethylene coating layer;

wherein the carton has a grammage less than 280 grams per square meter.

2. A hermetically sealed gable top carton for use in packaging liquid food, the carton having a plurality of side panels, a plurality of top panels and a plurality of bottom panels, each of the panels defined by a plurality of vertical score lines and horizontal score lines, the plurality of top panels formed into a gable top, the plurality of side panels formed into side walls, and the plurality of bottom panels formed into a sealed bottom, the carton comprising:

a corrugated layer composed of an inner facing sheet, an outer facing sheet and a plurality of flutes, each of the flutes fixedly positioned between the inner facing sheet and the outer facing sheet, the flutes having a density of between 200 to 400 flutes per linear foot and a height profile of 8 mils to 40 mils, the flutes defining a plurality of columns transverse to the plurality of vertical score lines;

a barrier layer adjacent the corrugated layer;

an exterior polyethylene coating layer; and an interior polyethylene coating layer;

wherein the carton has a grammage less than 280 grams per square meter.

* * * * *